US006222317B1

(12) United States Patent
Vollkommer et al.

(10) Patent No.: US 6,222,317 B1
(45) **Date of Patent: *Apr. 24, 2001**

(54) FLAT LIGHT EMITTER

(75) Inventors: Frank Vollkommer, Buchendorf; Lothar Hitzschke, Munich; Jens Muecke, Poecking; Rolf Siebauer, Feldkirchen; Simon Jerebic, Ergolding, all of (DE)

(73) Assignee: Patent-Treuhand-Gesellschaft fuer Elektrische Gluehlampen mbH, Munich (DE)

( * ) Notice: Subject to any disclaimer, the term of this patent is extended or adjusted under 35 U.S.C. 154(b) by 0 days.

This patent is subject to a terminal disclaimer.

(21) Appl. No.: 09/180,860

(22) PCT Filed: Mar. 20, 1998

(86) PCT No.: PCT/DE98/00829

§ 371 Date: Nov. 17, 1998

§ 102(e) Date: Nov. 17, 1998

(87) PCT Pub. No.: WO98/43279

PCT Pub. Date: Oct. 1, 1998

(30) Foreign Application Priority Data

Mar. 21, 1997 (DE) ..... 197 11 892

(51) Int. Cl.[7] ..... H01J 17/49

(52) U.S. Cl. ..... 313/582; 313/586; 313/485; 313/583

(58) Field of Search ..... 313/310, 582, 313/583, 584, 585, 586, 491, 485, 493

(56) References Cited

U.S. PATENT DOCUMENTS

| | | | | |
|---|---|---|---|---|
| 5,343,116 | * | 8/1994 | Winsor | 313/493 |
| 5,463,274 | * | 10/1995 | Winsor | 313/493 |
| 5,592,047 | * | 1/1997 | Park et al. | 313/484 |
| 5,850,122 | * | 12/1998 | Winsor | 313/493 |
| 6,034,470 | * | 3/2000 | Vollkommer et al. | 313/485 |

FOREIGN PATENT DOCUMENTS

| | | |
|---|---|---|
| 19526211 | 1/1997 | (DE) . |
| 0363832 | 4/1990 | (EP) . |
| 9423442 | 10/1994 | (WO) . |

* cited by examiner

*Primary Examiner*—Nimeshkumar D. Patel
*Assistant Examiner*—Karabi Guharay
(74) *Attorney, Agent, or Firm*—Robert F. Clark

(57) ABSTRACT

A flat radiator (4), suitable for a dielectrically impeded discharge and with a discharge vessel (5) made from an electrically non-conducting material has strip-like electrodes (6, 7) arranged on the wall of the discharge vessel (5), cathodes (6) and anodes (7*a*) being arranged alternately next to one another, and at least the anodes being separated from the interior of the discharge vessel (5) by a dielectric material (10). In each case one additional anode (7*b*) is arranged between neighbouring cathodes (6), that is to say in each case one anode pair (7*a*, 7*b*) is arranged between the neighbouring cathodes (6). The result is a uniform discharge structure accompanied by optimum utilization of the discharge vessel. FIG. 3*b*

9 Claims, 2 Drawing Sheets

FLAT LIGHT EMITTER

TECHNICAL FIELD

At issue here, in particular, are flat radiators as disclosed, for example, in EP 0 363 832 and in DE-A 195 26 211. Such radiators have at least one electrode separated from the discharge chamber of the radiator by dielectric material. Such electrodes are also designated as "dielectric electrodes" below for short.

The designation "flat radiator" is understood here to mean radiators having a flat geometry and which emit light, that is to say visible electromagnetic radiation, or ultraviolet (UV) or vacuum ultraviolet (VUV) radiation.

Depending on the spectrum of the emitted radiation, such radiation sources are suitable for general and auxiliary lighting, for example home and office lighting or background lighting of displays, for example LCDs (Liquid Crystal Displays), for traffic lighting and signal lighting, for UV irradiation, for example sterilization or photolysis.

BACKGROUND OF THE INVENTION

EP 0 363 832 discloses an UV high-power radiator having elongated electrodes connected in pairs to the two terminals of a high-voltage source. In this case, the electrodes are separated from one another and from the discharge chamber of the radiator by dielectric material. Furthermore, the elongated electrodes are arranged alternately next to one another with different polarity (anodes and cathodes), it being possible in this way to realize planar-like discharge configurations with relatively flat discharge vessels.

WO 94/23442 discloses a method for operating an incoherently emitting radiation source, in particular a discharge lamp, by means of dielectrically impeded discharge. The operating method provides for a sequence of active power pulses, the individual active power pulses being separated from one another by dead times. Here, in the case of unipolar pulses a multiplicity of individual delta-shaped discharges lined up along the elongated electrodes are formed. The advantage of this pulsed mode of operation is a high efficiency in the generation of radiation.

If, now, the method of WO 94/23442, for example, is applied to the flat radiator of EP 0 363 832—as already described in DE-A 195 26 211—, it is found that the individual discharges are formed only between the anodes and one of the two respectively directly neighbouring cathodes. It cannot be predicted by which of the two neighbouring cathodes the discharges will be formed in each case. Discharges which burn from neighbouring cathode strips onto one and the same anode are not observed. Referring to the flat radiator as a whole this results in a non-uniform discharge structure. A further disadvantage is the fact that the power density is limited by the phenomenon outlined.

SUMMARY OF THE INVENTION

It is the object of the present invention to eliminate the said disadvantages and to provide a flat radiator having an increased power density and improved luminance distribution.

This object is achieved by means of the characterizing features of claim 1. Particularly advantageous embodiments are to be found in the dependent claims.

Starting from the prior art, the invention proposes the separation into in each case two anodes of those anodes which have equally spaced cathodes as direct neighbours. In other words, an additional anode is arranged between each such cathode pair.

Reference is made to FIGS. 1 and 2 for the further explanation of this inventive principle. By way of example, one section each of a flat radiator according to the invention and of a conventional one are represented diagrammatically. For the sake of simplicity and clarity, the lengths of the electrodes are limited approximately to the extent of a delta-shaped individual discharge. In a concrete design of a flat radiator, the electrodes are typically much longer, with the result that during operation a multiplicity of individual discharges burn along electrodes. However, the length of the electrodes does not play a decisive role in explaining the inventive principle. FIGS. 1 and 2 represent, as it were, in principle the conditions per unit of length of the electrodes.

According to the invention, an anode pair $A_i$, $A_i'$ is arranged between at least one, preferably between each cathode pair $K_i$, $K_{i+1}$, i =1,2, . . . n and n denotes the number of cathodes (in FIGS. 1 and 2, n=4 is selected, for example). As a result of this measure, each anode $A_i$, $A_i'$ have at most one cathode $K_i$ or $K_{i+1}$, respectively, as a direct neighbour.

Consequently—assuming sufficient electric input power—during operation the individual discharges i, i' form from each anode $A_i$, $A_i'$ to the respectively directly neighbouring cathode $K_i$ and $K_{i+1}$, respectively. The disadvantage of the prior art, specifically that individual discharges burn at most to one of two neighbouring cathodes (compare FIG. 2) is thereby avoided.

Whereas in the example of FIG. 1 with four cathodes K1–K4 it is possible according to the invention—assuming an adequate electric input power—to achieve a total of up to six individual discharges 1,1'–3,3' per unit of length of the electrodes, in the case of a comparable arrangement in accordance with the prior art (see FIG. 2) the figure is only four individual discharges 1–4. Moreover, the arrangement according to FIG. 2 has the disadvantage, already mentioned, that it is not possible to predict to which of the neighbouring cathodes $K_i$, $K_{i+1}$ the discharge i will ignite. FIG. 2 thus shows only one of a plurality of possible discharge structures.

The mutual spacing of each anode pair $A_i$, $A_{i'}$ is smaller than the spacing between a respective anode $A_i$ or $A_{i'}$ and a directly neighbouring cathode $K_i$ or $K_{i+1}$, respectively. The area between the anode pairs which cannot be used for the discharge is thereby kept relatively small. A favourable value for the mutual spacing is the approximate width of the anode strips.

In one embodiment, the two anodes $A_i$, $A_i'$ are constructed as a fork-shaped double anode. For this purpose, the double anode has a respectively elongated first and second region, which are arranged at a predetermined spacing from one another. The first and the second region are connected to one another by a third region to form a unit.

DESCRIPTION OF THE DRAWINGS

The invention is to be explained below in more detail with the aid of an exemplary embodiment. In the drawings.

DETAILED DESCRIPTION OF THE INVENTION

Figure 1:
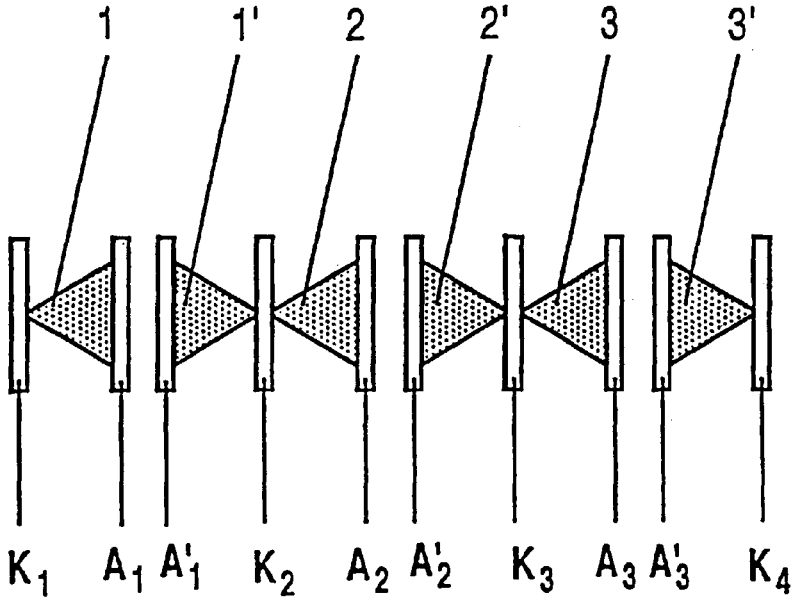
FIG. 1 shows a diagrammatic representation of the principle of the invention.
Figure 2:
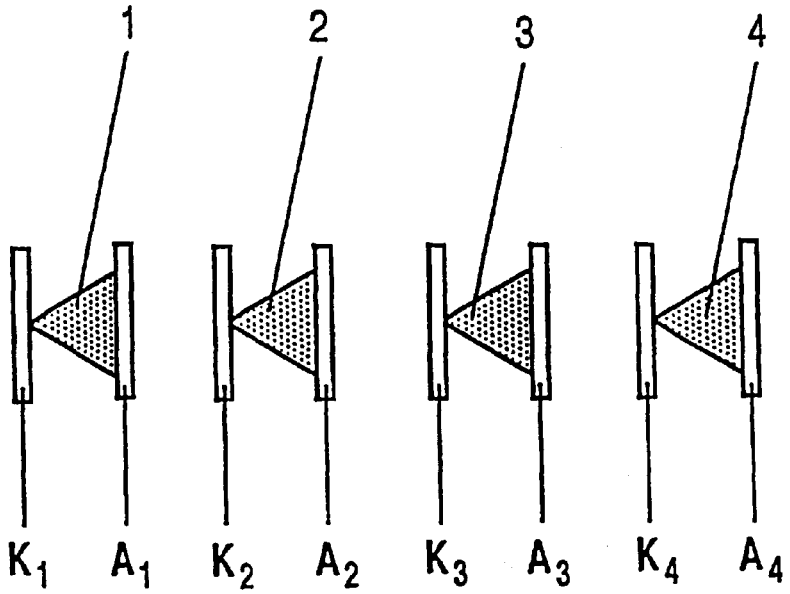
PRIOR ART FIG.2
FIG. 2 shows a diagrammatic representation of the principle of the prior art.
Figure 3A:
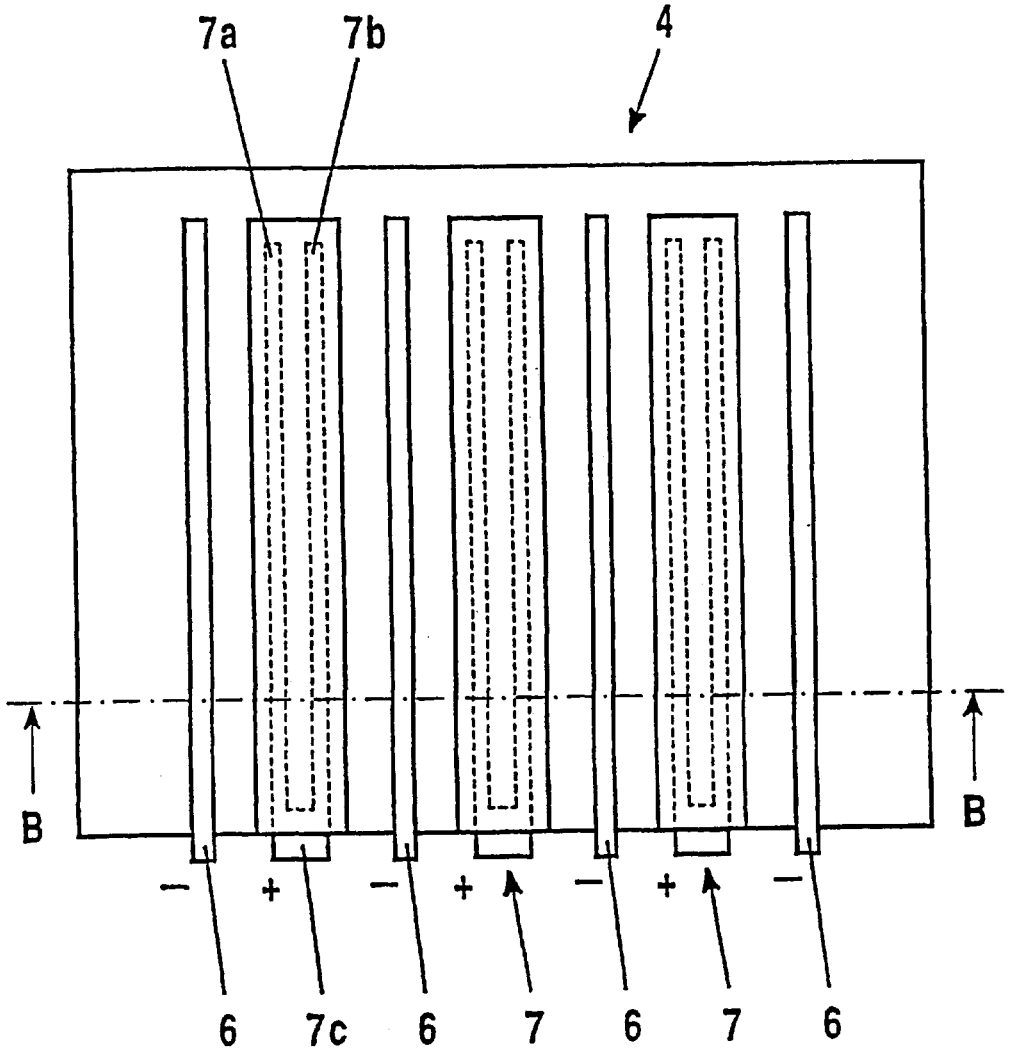
FIG. 3*a* shows a diagrammatic representation of the top view of an exemplary embodiment of a flat radiator according to the invention.
Figure 3B:
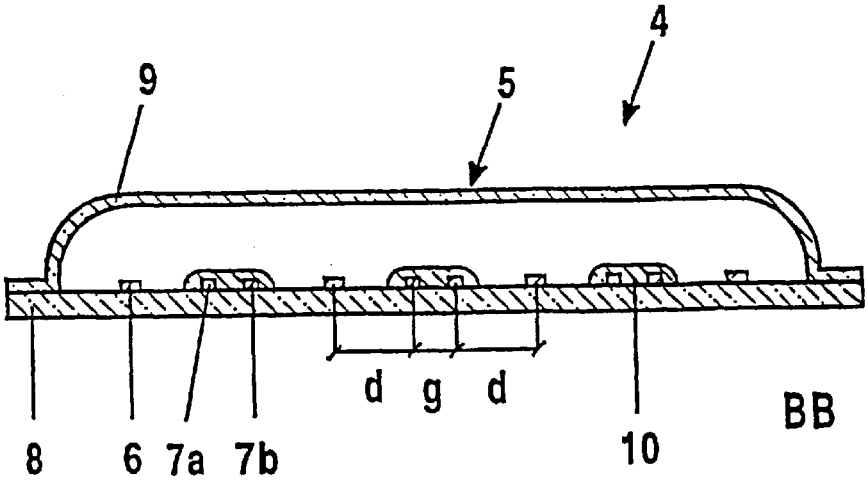
FIG. 3*b* shows a diagrammatic representation of the cross-section of the flat radiator of FIG. 3*a*.

FIGS. 3*a*, 3*b* respectively show, in a diagrammatic representation, a top view and a cross-section along the line BB of a UV/VUV flat radiator 4, that is to say a flat "discharge lamp", which is designed for the efficient emission of UV or VUV radiation, respectively. The flat radiator 4 comprises a flat discharge vessel 5 with a rectangular base face, four strip-shaped metallic cathodes 6 (–) and three elongated, fork-shaped double anodes 7 (+). The discharge vessel 5 comprises, for its part, a rectangular base plate 8 and a trough-like cover 9 (not represented in FIG. 3*a*), both made from glass. The base plate 8 and the cover 9 are connected to one another in a gas-tight fashion in the region of their circumferential edges, and thus enclose the gas filling of the flat radiator 4. The gas filling consists of xenon with a filling pressure of 10 kPa. The double anodes 7 respectively comprise two mutually parallel strips 7*a*, 7*b*, which are combined at one of their ends to form a common broad strip 7*c*. The cathodes 6 and double anodes 7 are mounted parallel to one another on the inner wall of the base plate 8. The wide end strips 7*c* of the double anodes 7 and the ends of the cathodes 6 are guided outwards in a gas-tight fashion from the discharge vessel 5 and serve there as terminals for a voltage source. By contrast with the cathodes 6, the double anodes 7 are covered completely in each case inside the discharge vessel 5 by a glass layer 10 whose thickness is approximately 150 $\mu$m. The respective spacing d between the cathode 6 and the directly neighbouring strip 7*a* or 7*b* of the double anode 7 is approximately 10 mm. The mutual spacing g of the two parallel strips 7*a*, 7*b* is approximately 3 mm. A multiplicity of individual discharges (not represented in FIGS. 3*a*, 3*b*) form during operation. These individual discharges burn between the respective cathode 6 and the corresponding directly neighbouring strip 7*a* or 7*b*, respectively, of the associated double anode 7. By comparison with arrangements without a double anode (and the same geometrical dimensions of the discharge vessel) which have been used previously, the gain achieved in power density which can be injected is nearly 75%.

One variant (not represented) differs from the flat radiator represented in FIGS. 3*a*, 3*b* only in that not only the anodes but also the cathodes are separated from the interior of the discharge vessel by a dielectric layer (discharge dielectrically impeded at two ends).

In a further variant (not represented), the inner wall of the discharge vessel is coated completely with a fluorescent material or mixture of fluorescent materials, which converts the UV/VUV radiation generated by the discharge into visible light. Furthermore, one light-reflecting layer each made from $A1_2O_3$ or $TiO_2$, respectively, is applied to the inner wall of the base plate. They serve to increase the luminous density on the top side of the radiator. This variant is a flat fluorescent lamp which is suitable for general lighting or background lighting of displays, for example LCD (Liquid Crystal Display).

What is claimed is:

1. Flat radiator (4) having an at least partially transparent discharge vessel which is closed (5) and filled with a gas filling or open and flowed through by a gas or gas mixture and consists of electrically non-conducting material, and having elongated electrodes (6, 7) arranged on the wall of the discharge vessel (5), cathodes (6) and anodes (7*a*) being arranged alternately next to one another, and at least the anodes being separated from the interior of the discharge vessel (5) by a dielectric material (10), characterized in that in each case one additional anode (7*b*) is arranged between neighbouring cathodes (6), that is to say in each case one anode pair (7*a*, 7*b*) is arranged between the neighbouring cathodes (6).

2. Flat radiator according to claim 1, characterized in that in each case the mutual spacing (g) of the individual anodes of the anode pairs (7*a*, 7*b*) is smaller than the spacing (d) between the anode (7*a*; 7*b*) and directly neighbouring cathode (6).

3. Flat radiator according to claim 1, characterized in that in each case the mutual spacing (g) of the individual anodes of the anode pairs (7*a*, 7*b*) is in the region between approximately half the width and double the width of the anodes.

4. Flat radiator according to claim 3, characterized in that in each case the mutual spacing (g) of the individual anodes of the anode pairs (7*a*, 7*b*) corresponds approximately to the width of the anodes.

5. Flat radiator according to claim 1, characterized in that in each case the two anodes arranged between neighbouring cathodes (6) are constructed as a fork-shaped double anode (7) having an in each case elongated first region (7*a*) and a second region (7*b*), the first region (7*a*) and the second region (7*b*) of the double anode (7) being arranged at a predetermined spacing from one another, and the first region (7*a*) and the second region (7*b*) being connected to one another by a third region (7*c*) to form a unit.

6. Flat radiator according to claim 5, characterized in that the length of the third region (7*c*) is shorter than approximately a tenth of the length of the first region (7*a*) or of the second region (7*b*).

7. Flat radiator according to claim 5, characterized in that the double anodes (7) are partly guided outwards in a gas-tight fashion from the discharge vessel (5), the third region (7*c*) of each double anode (7) serving there in each case as a terminal for a power supply.

8. Flat radiator according to claim 1, characterized in that the electrodes (6, 7) are mounted on the inner wall of the discharge vessel (5), and in that in each case at least the part of the anode pair (7) extending inside the discharge vessel (5) is completely covered by a dielectric layer (10).

9. Flat radiator according to claim 1, characterized in that the inner wall of the discharge vessel is at least partly provided with a fluorescent material layer.

* * * * *